US008313260B2

(12) United States Patent
Nouhant et al.

(10) Patent No.: US 8,313,260 B2
(45) Date of Patent: Nov. 20, 2012

(54) DEVICE FOR COMPENSATION FOR THE VARIATION OF WIDTH OF A FLEXIBLE PRINTING SUBSTRATE AND PRINTING MACHINE THAT COMPRISES SUCH A DEVICE

(75) Inventors: Rene Nouhant, Bretigny sur Orge (FR); Sébastien Nouhant, Bretigny sur Orge (FR)

(73) Assignee: Diffusion de Materiel et d'Imprimerie, Bertigny sur Orge (FR)

( * ) Notice: Subject to any disclaimer, the term of this patent is extended or adjusted under 35 U.S.C. 154(b) by 716 days.

(21) Appl. No.: 12/439,737

(22) PCT Filed: Aug. 29, 2007

(86) PCT No.: PCT/FR2007/001412
§ 371 (c)(1),
(2), (4) Date: May 1, 2009

(87) PCT Pub. No.: WO2008/029013
PCT Pub. Date: Mar. 13, 2008

(65) Prior Publication Data

US 2010/0054840 A1 Mar. 4, 2010

(30) Foreign Application Priority Data

Sep. 4, 2006 (FR) ..... 06 07714

(51) Int. Cl.
*B41J 13/00* (2006.01)
*B65H 20/00* (2006.01)
*B65H 23/24* (2006.01)
*B41F 13/24* (2006.01)

(52) U.S. Cl. . 400/642; 226/97.1; 226/97.3; 242/615.11; 101/232; 271/3.14

(58) Field of Classification Search ..... 400/642; 226/7, 97.1–97.3; 101/232; 242/615.11
See application file for complete search history.

(56) References Cited

U.S. PATENT DOCUMENTS

| | | | | |
|---|---|---|---|---|
| 4,696,230 | A | 9/1987 | Barkley | |
| 5,924,619 | A * | 7/1999 | Bartell | 226/7 |
| 6,021,713 | A | 2/2000 | Glockner et al. | |
| 2003/0075293 | A1 * | 4/2003 | Moeller et al. | 162/193 |

FOREIGN PATENT DOCUMENTS

| | | |
|---|---|---|
| EP | 0 838 420 | 4/1998 |
| EP | 0 938 414 | 2/2002 |

OTHER PUBLICATIONS

International Search Report dated Feb. 25, 2008, from corresponding PCT application.

* cited by examiner

*Primary Examiner* — Michael G Lee
*Assistant Examiner* — Laura Gudorf
(74) *Attorney, Agent, or Firm* — Young & Thompson

(57) ABSTRACT

A device for compensating for the variation in width of a flexible print support (1) progressing through a multicolor printing machine, between successive rotary printing assemblies, by a stream of air directed towards the print support in order to alter its flatness, includes at least one pair of deflectors (2) positioned symmetrically one on each side of the line of travel of the print support, each deflector (2) including an air blowing chamber (6) opening onto the surface (11) of the deflector that faces towards the print support and being directed towards the rear of the deflector in the direction of travel of the support, so as to produce an air stream in the form of a flat sheet of air capable, at the same time, of making it easier to keep the support away from the surface of the deflector and to continue forced travel of the print support.

9 Claims, 5 Drawing Sheets

DEVICE FOR COMPENSATION FOR THE VARIATION OF WIDTH OF A FLEXIBLE PRINTING SUBSTRATE AND PRINTING MACHINE THAT COMPRISES SUCH A DEVICE

This invention relates to the field of printing, in particular the multi-color printing machines, and more particularly the devices for compensation for the variation of width of the flexible printing substrates, such as sheets or strips.

During the production of printing works on sheets or strips of paper, in particular for works in color, a variation of the width of these sheets or strips after their travel into the successive rotating printing units is frequently observed. Actually, these flexible printing substrates (based on paper or another material) receive a significant hydrometric supply during inking (for example in the offset printing process) and at the same time undergo lamination or pressing between the rotating cylinders (blanket cylinders) that transfer the ink to the printing substrate.

These two cumulative actions generate a gradual lateral expansion of the printed substrate during the printing with each successive printing unit. As far as the paper is concerned, the expansion is based on the grammage, the width and the storage conditions of the paper spools; it can also vary between two successive spools of the same production, and even between the layers of the same spool, whereby the outside layers have been able to undergo pleats during the winding thereof and are generally more exposed to atmospheric variations (for example, hygrometric) than the internal layers of the spool.

This phenomenon that is called "fan-out" disrupts the superposition of the colors in the four-color process printing, in particular in photos, patterns, landscapes . . . in the transverse direction of the paper strip. In particular, it brings about a degradation of the definition of photographs because the screens of the successively printed colors are not perfectly superposed or aligned over the entire width of the paper strip.

To counter or limit this "fan-out" phenomenon, various systems are currently used.

Casters that are arranged at the inlet of each printing unit make it possible, by resting on the paper strip, to exert stress on the latter so as to reduce its width. These casters can be adjusted in height so as to adapt the stress based on different conditions. The contact with ink should be avoided; they can be used only on non-printed zones, which considerably limits their field of application.

To prevent the traces left by the casters, pulsed-air systems using nozzles or jets that are installed instead of the above-described casters are used, making it possible to deform the printable substrate without contact with the latter. However, the deformation capacity of the printing substrate by these systems is imperfect because their action is linked to the compressed air flow. If the flow rate is too low, the deformation is inadequate for compensating for the widening of the paper strip, and if the flow rate is too high, it runs the risk at low speed of the paper strip becoming damaged, and even the latter being locally perforated. In addition, the use of these pulsed-air devices will bring about a significant consumption of compressed air and is particularly noisy because of the intermittent air leaks.

To eliminate these drawbacks, this invention has as its object to propose a device for compensation for the variation of width of a flexible printing substrate that is simple, reliable and applicable at different speeds of advance of the printing substrate. The compensation device should also be quiet and usable for printed and non-printed surfaces, therefore preferably without contact with the printing substrate. It should also be adaptable to all of the substrate widths.

For this purpose, the device according to this invention for compensation for the variation of width of a flexible printing substrate, in particular in sheet or strip form, that passes, in particular in a multi-color printing machine, between generally rotating printing means that are organized in the form of successive printing units, by means of an air flow directed toward the printing substrate for the purpose of modifying its surface evenness, is characterized in that it comprises at least one pair of deflectors that are arranged symmetrically on both sides of the axis along which the printing substrate passes, whereby each deflector comprises an air-blowing chamber that empties onto the surface of the deflector that is rotated toward the printing substrate, oriented in the direction toward the rear of the deflector in the direction in which said substrate passes, so as to produce an air flow in the form of an air knife for the purpose of facilitating, in parallel, the separation of said substrate from the surface of the deflector and the accompaniment of the entrainment in movement of said printing substrate.

Actually, it was noted that the elongation of the width of the printing substrate evolves on both sides of the central axis of the substrate by being amplified proportionally and gradually in the travel to each printing unit by leaving a neutral central zone. This neutral zone that does not require corrections of or compensations for said substrate is used as a reference for the superposition of colors. The deflectors of the same pair are therefore arranged advantageously on both sides of this neutral zone, symmetrically to the axis along which the printing substrate passes. In the case of a substrate of great width, one or more pairs of additional deflectors can be arranged by moving away from the central axis in the direction of the edges or borders of the printing substrate.

The air flow that is produced by the air blowing chamber of the deflector is in the form of a thin air knife, emitted at the surface of the deflector and directed toward the rear, in the direction in which the substrate passes. This air knife generates an air cushion that simultaneously separates the substrate from the surface of the deflector by modifying the surface evenness of said substrate and facilitates the travel of said substrate by accompanying its movement.

When the deflector is placed, for example, below the substrate, the height of the latter is raised locally, and this deformation compensates for its transverse elongation, without contact. Such a deformation can therefore take place at non-printed zones as well as printed zones of the substrate.

According to other advantageous characteristics of the invention:

- The blowing chamber is formed, crosswise to the axis along which the printing substrate passes, by two approximately parallel walls (or walls that are slightly separated from one another in the direction of the printing substrate), oriented toward the rear of the deflector in the direction in which said substrate passes, whereby of the two walls, the upstream one is concave, and the other downstream one is convex, or flat and oblique. Thus, the air knife is directed toward the rear of the deflector.
- The deflector is formed, in the direction in which the printing substrate passes, by a front part and a rear part that are mounted on a base, whereby the rear face of the front part and the front face of the rear part form the walls (for example respectively concave and convex) of the blowing chamber. The front part, the rear part, and the base of the deflector can consist of a single part or several parts. According to a preferred embodiment, the rear part of the deflector and the base form a single part.

The front part of the deflector has an increasing thickness in the direction in which the printing substrate passes, and the rear part has a thickness that is more than the front part and comprises, from the front toward the rear, an oblique or rounded leading edge and a flat surface that is approximately parallel to the plane in which the printing substrate passes. Thus, the air that is located between the front of the deflector and the printing substrate undergoes, by Venturi effect, suction that also promotes the above-mentioned effects of separation and entrainment of the substrate, and reduces the necessary consumption of compressed air.

The rear face of the deflector is beveled or rounded, whereby the surface that is rotated toward the printing substrate projects beyond the surface upon contact with the base, directly at the base of the plane in which said substrate passes, so as not to cause the printing substrate to become plated just behind the deflector.

The rear part of the deflector has rounded longitudinal sides.

The air blowing chamber advantageously has a central position in the deflector; thus, the air knife is distributed over all of the "active" surfaces of the rear part of the deflector so as to prevent contact with the printable substrate and consequently to avoid traces of ink on the non-printed zones of said substrate.

The chamber also comprises longitudinal walls that are formed by connected parts also to constitute blocks for adjusting the spacing of the transverse walls relative to one another. Thus, the thickness of the air knife can be increased or decreased by modifying said blocks. Said blocks are also used as a sealing joint to prevent the lateral escape of air flow.

The deflectors are stationary and can be attached to transverse beams that are located close to the plane in which the printing substrate passes.

This invention also relates to printing machines of the offset printing type or else of the heliogravure or flexography printing type including the device that is described above.

The offset printing machine comprises at least one device for compensation for the variation of width of the printing substrate as described above, arranged downstream from at least one printing unit, so as to deform the printing substrate locally for the purpose of compensating for the broadening of the width of said substrate that takes place during its printing in the upstream printing unit or units.

The printing machine of the heliogravure printing type or flexography printing type comprises at least one device for compensation for the variation of width of the printing substrate as described above, arranged upstream from at least one printing unit so as to deform locally the printing substrate for the purpose of anticipating and compensating for the constriction of the width of said substrate that takes place in particular during its drying, downstream from the printing unit.

Other advantages and details of this invention will emerge from the description of one embodiment, provided by way of nonlimiting example, with reference to the accompanying drawings in which.

The example that is described below presents an embodiment of a device for compensation for the variation of width of a flexible printing substrate according to this invention, designed here to act on a printing substrate that consists of a paper strip 1 that passes at high speed between successive printing units G1, G2, G3 and G4 (see FIG. 7).

Figure 1:
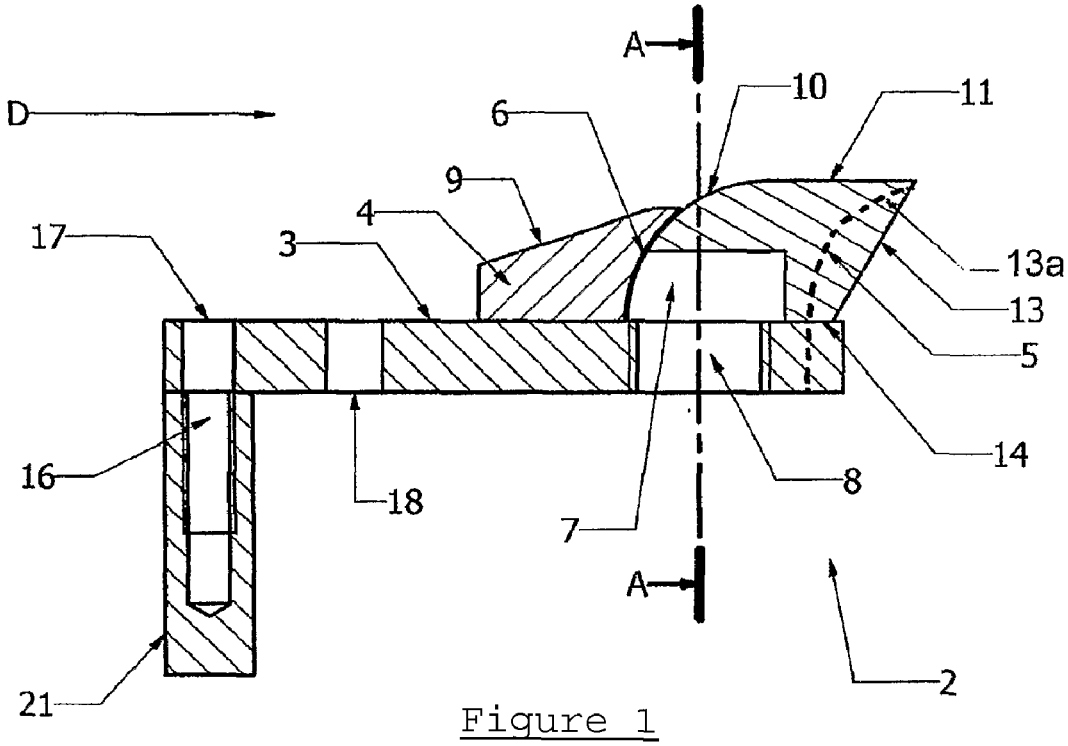
FIG. 1 is a longitudinal cutaway view of the deflector of a compensation device according to a first variant of the invention.
Figure 2:
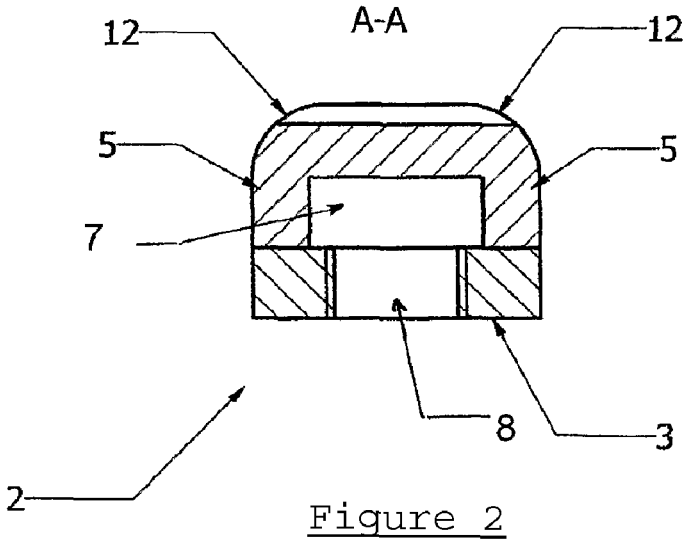
FIG. 2 is a transversal cutaway view along AA of the deflector of FIG. 1.
Figure 3:
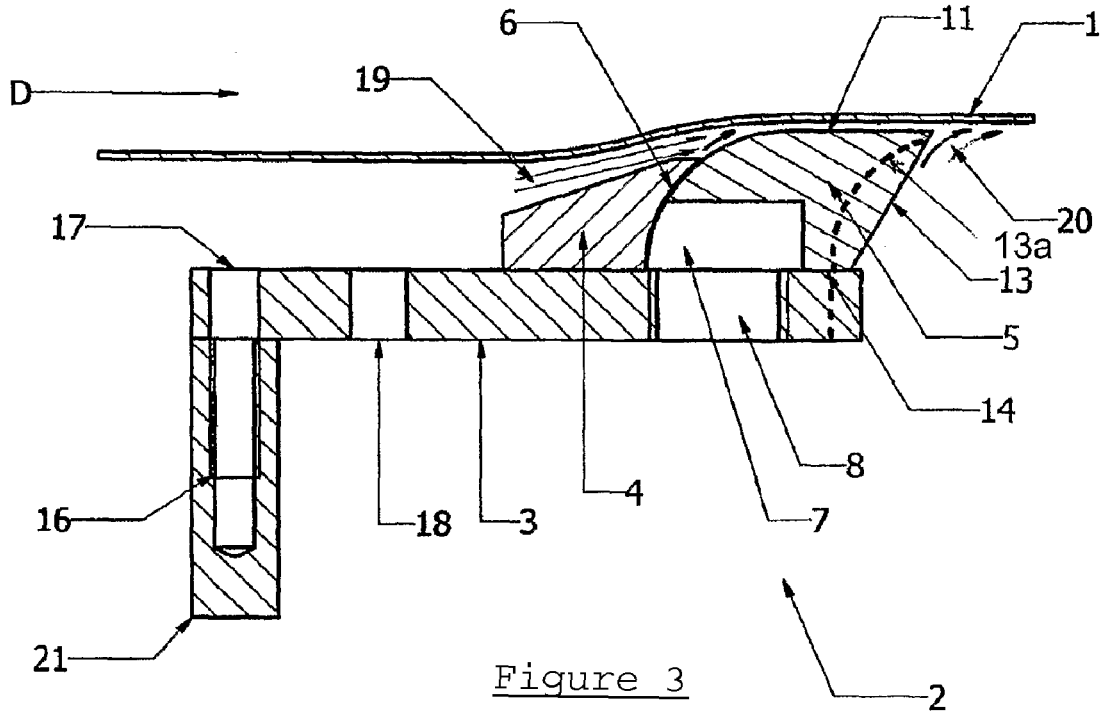
FIG. 3 is a longitudinal cutaway view of the deflector according to FIG. 1 in the presence of the printing substrate.
Figure 8:
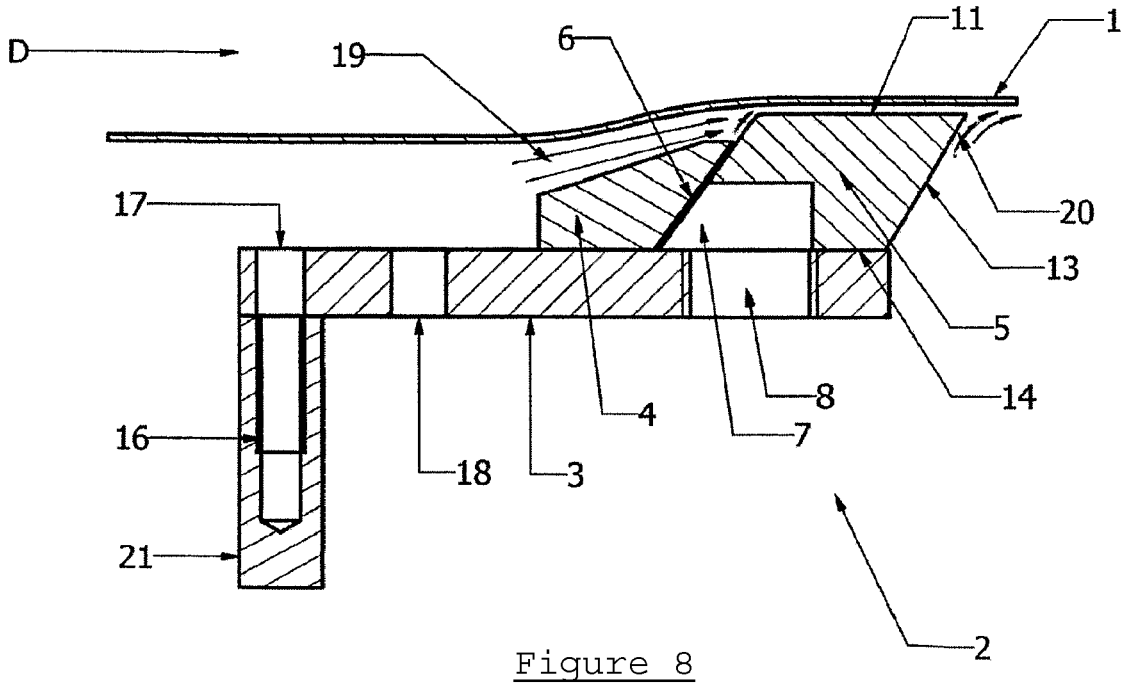
FIG. 8 is a longitudinal cutaway view of the deflector of a compensation device according to a second variant of the invention, in the presence of the printing substrate.

The compensation device comprises a pair of stationary deflectors 2 here. In reference to FIGS. 1 to 6, each deflector 2 is formed by a base 3 on which are mounted, in the direction D in which the paper strip passes, respectively a front part 4 and a rear part 5 that are separated by an air blowing chamber 6. According to a first variant of the invention (cf. FIGS. 1 and 4), the rear face of the front part 4 has a concave shape that adapts to the convex shape of the front face of the rear part 5. According to a second variant of the invention, the rear face of the front part 4 and the front face of the rear part 5 are flat and oblique (cf. FIG. 8). In the two variants, these two faces, slightly separated from one another, form transverse walls of the blowing chamber 6. These two walls are approximately parallel and are oriented, as can be seen in FIGS. 1 and 3, in the direction toward the rear of the deflector 2 in the direction D in which the printing substrate paper strip 1 passes.

Recesses 7 and 8 are respectively provided in the rear part 5 of the deflector 2 and in the base 3 for the purpose of the supply of compressed air of the blowing chamber 6.

The air blowing chamber 6 empties onto the surface (here, the upper surface) of the deflector 2 that is rotated toward the paper strip 1 and produces an air flow in the form of an air knife that is inclined toward said strip 1 and oriented in the direction toward the rear of the deflector 2.

For this purpose, the upper surface of the deflector has the shape of an upward slope that is terminated by a "plate," whereby the upward slope is formed by the upper surface 9 of the front part 4 and by the leading edge 10 of the rear part 5 of the deflector 2.

The rear part 5 of the deflector, higher than the front part 4, ends by a flat upper surface 11 that forms a "plate" that is approximately parallel to the plane in which the paper strip 1 passes. The travel plane is defined here as the plane that is formed by the printing substrate 1 between two successive printing units without the intervention of the compensation device according to the invention.

The rear part 5 of the deflector 2 also has rounded longitudinal sides 12 that accommodate a fraction of the air knife so as to prevent contact with the printable substrate. The rear face 13 of the deflector is also beveled, whereby at the base of the plane in which said strip passes, the flat upper surface 11 projects beyond the surface 14 that is in contact with the base 3.

According to another embodiment, shown in dotted lines in FIGS. 1 and 3, the rear face 13*a* of the deflector may have a rounded shape.

These beveled or rounded shapes allow the downstream air flow 20 (shown in FIGS. 3 and 8) rising along this beveled face to accompany the air knife that was already formed under the printing substrate 1, so as to prevent said substrate from becoming plated against the rear of the deflector 2.

Figure 5:
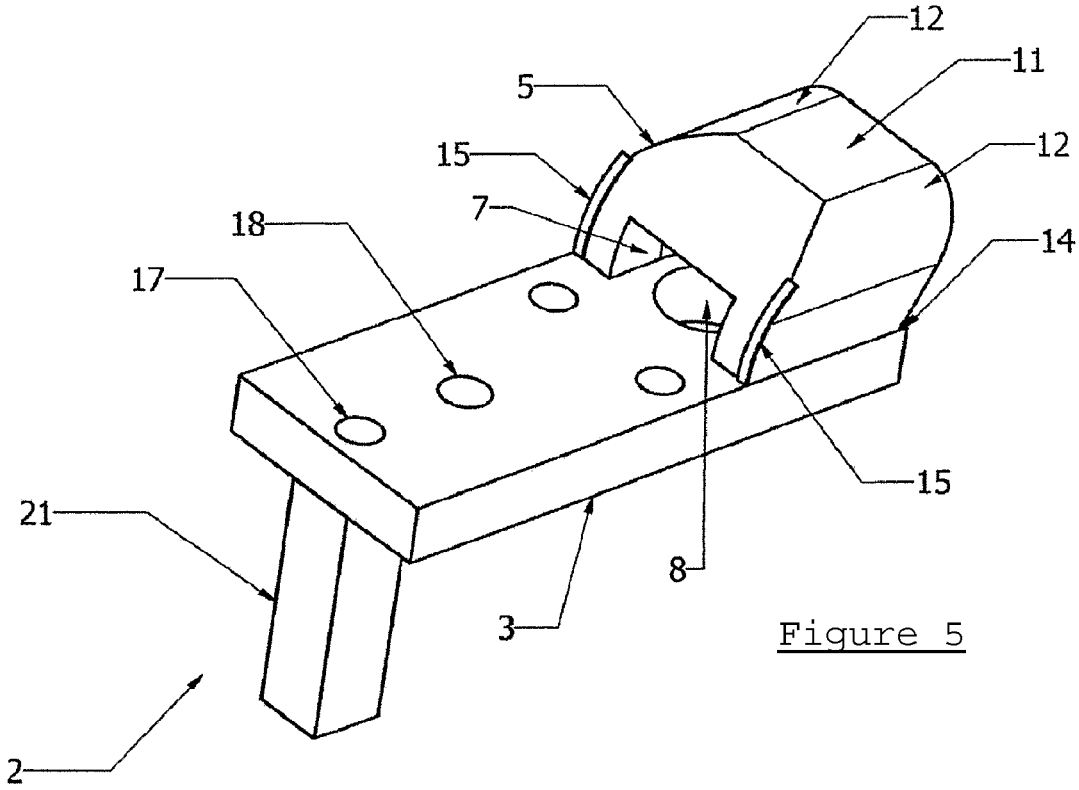
FIG. 5 is a partial perspective view of a deflector of the compensation device according to the invention.
Figure 6:
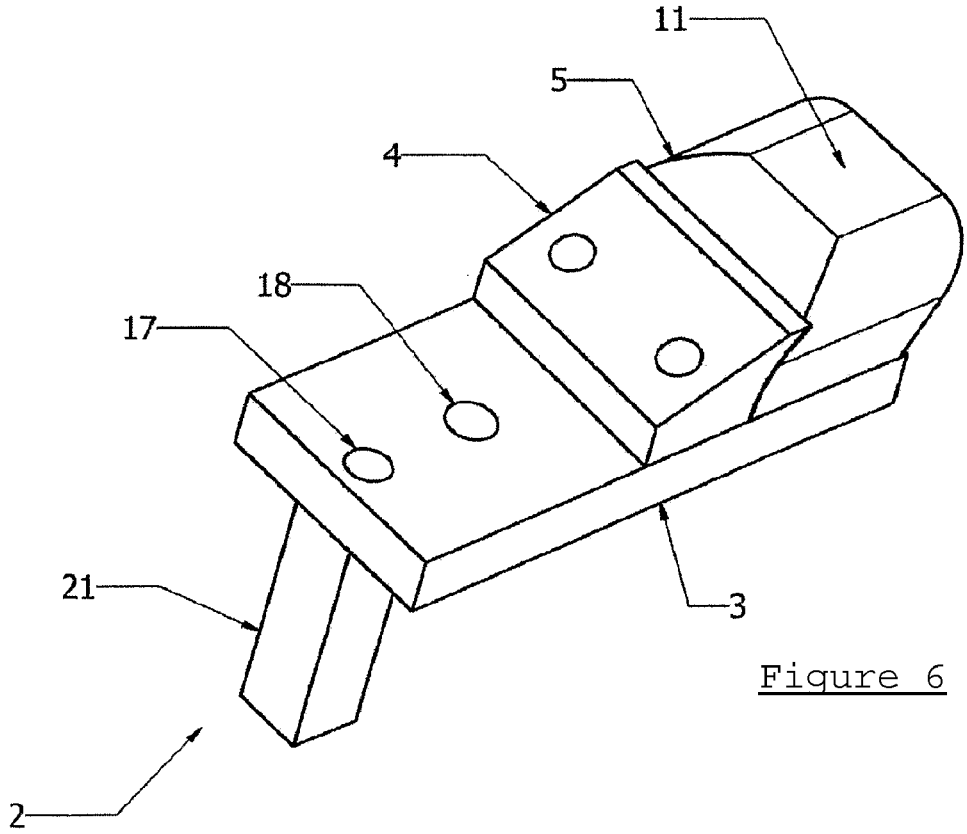
FIG. 6 is a perspective view of a deflector of the compensation device according to the invention.

Parts 15, called blocks, visible in FIG. 5, that make it possible to separate the two parts 4 and 5 from one another and that form longitudinal walls of the blowing chamber 6 while serving as a sealing joint of this chamber are positioned between the front part 4 and the rear part 5 of the deflector.

An opening 18 that allows it to be attached to the end of the rod of a single-action pneumatic cylinder (not shown), whose travel is, for example, approximately 10 to 20 millimeters, making it possible to move the deflector 2 vertically relative to the printable substrate 1, is provided in the base 3 of the deflector 2. The deflector 2 also has, at the front end of its base 3, an end opening 17 that makes it possible, by means of a screw, to attach there an anti-rotational guide 21, which ensures the positioning of the deflector parallel to the X-axis along which the paper strip 1 passes.

Figure 4:
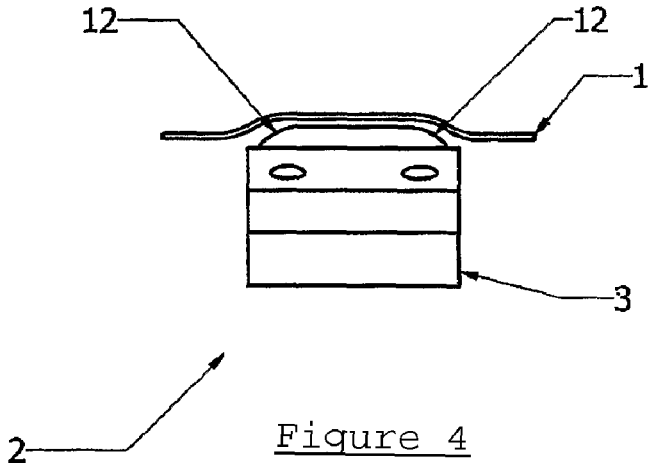
FIG. 4 is a front view of the deflector of FIG. 3.

As can be seen in FIGS. 3 and 4, the printing substrate, here the paper strip 1, passing in the direction of travel D, is deformed in the travel above the deflector 2. Its deformation is gradual in the longitudinal direction because there is a tension of the paper strip between the cylinders of the successive printing units, but more pronounced in the transverse direction of the paper strip (see FIG. 4).

Using the air cushion that is formed by the air knife that is exiting, in the upper part of the deflector 2 and on the rounded longitudinal sides 12, from the air blowing chamber 6 as well as the upstream air 19 that is drawn in by Venturi effect (and optionally the downstream air 20 that is moved by the air flow that is entering opposite the paper strip), the deformation of said strip 1 is carried out without contact with the upper surface of the deflector 2. In addition, the travel of the paper strip is facilitated.

Figure 7:
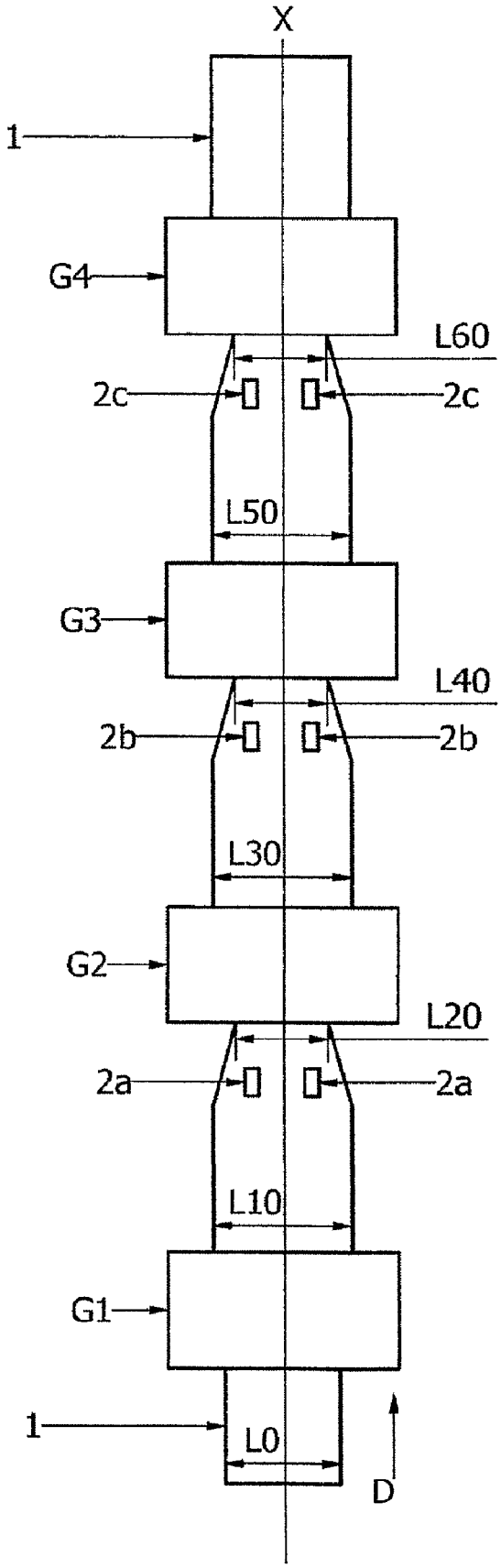
FIG. 7 is a diagram that illustrates the positioning and the action of the compensation device in a printing machine according to the invention.

FIG. 7 shows in diagram form the operation of an offset-type printing machine, for example in four-color process printing. The paper strip 1 that is obtained from a spool (not shown) travels along the X-axis by passing successively into the printing units G1, G2, G3 and G4, each affixing a color on said strip. After passing into the first printing unit G1, this paper strip 1 with an initial width L0 has a width L10 that is greater than the width L0, whereby the increase in width is induced by the hygrometric supply and the pressing between the cylinders of the printing unit G1.

A device for compensation for this width increase, consisting of two deflectors 2*a*, is placed upstream from the intake into the printing unit along G2 and makes it possible to reduce the width L10 to a width L20 that is close to L0. Downstream from the printing unit G2, the width of the paper strip 1 is again increased and has the value L30, which is again reduced using a pair of deflectors 2*b* placed upstream from the travel of the strip 1 into the printing unit along G3. The new width at the intake of this unit G3 is L40, which is approximately equal to the width L20. After the travel into the printing unit G3, the width of the strip is again increased and assumes the value L50, which in turn is compensated for by means of a new pair of deflectors 2*c*. The new width that is obtained is L60, close to the preceding value L40, before the strip 1 passes through the last printing unit G4.

Optimally, after correction by means of deflectors 2*a*, 2*b*, 2*c*, the strip 1 regains its initial width, i.e., L60=L40=L20=L0, so that the successive printed colors are perfectly superposed in the printing that is done on the strip 1 by the printing unit G1.

The flow rate of the air stream brought into the blowing chamber 6 is reset to the original rate; the stress or pressure exerted by each deflector 2, 2*a*, 2*b* or 2*c* on the strip 1 can be adjusted by making the deflector rise or drop vertically. These adjustments can be carried out in particular to make possible a better superposition of the colors that are successively printed on the paper strip.

It may be provided that the deflectors (2, 2*a*, 2*b*, 2*c*) start up when the printing machine exceeds a certain rpm threshold (for example, 5,000 rpm) by means of the opening of the pneumatic circuit that simultaneously supplies the cylinder and the blowing chamber 6 of the deflector; the cylinder then moves the deflector against the printable substrate 1 (which constitutes the work position), and the compressed air flow (under a pressure that is close to 5 to 6 bar) is directed into the blowing chamber 6, then into the direction of the printable substrate by forming the air cushion that is described above. When the printing machine passes below the threshold (set at, for example, 5,000 rpm), the pneumatic circuit closes: the cylinder then sets aside the deflector (by means of, for example, a spring that is integrated in the cylinder) because of the absence of pressure, and the air flow that passes through the blowing chamber is interrupted: the deflector that is separated from the printable substrate is then in so-called rest position.

During operation (so-called active position of the deflector), the air flow is regulated by the blocks 15 that are pre-positioned between the front part 4 and the rear part 5 of the deflector and by a pressure regulator (not shown) that is installed on the compressed air supply.

The adjustment of the stress exerted by each deflector on the printable substrate 1 can be carried out manually by the operator or can be motorized and controlled remotely from the control panel of the machine. It can also be automated and run by an automatic control system that is provided with scanners or cameras, which by positioning comparison controls the spots or marks of colors placed on the form by the printer and printed on the paper strip. Such a system then permanently controls the positioning of successive color spots and corrects the color superposition defects by acting on the motors that adapt the stress of each deflector to the printable substrate, by taking as a reference the printed color in the unit G1.

The deflector of the compensation device according to the invention offers numerous advantages, in particular:

The overall rounded shape of the upper surface of the deflector makes it possible not to snag the paper strip in particular during the slowing and stopping of the strip 1 when it passes, contrary to the conventional blowing nozzles that run the risk at any moment of damaging or perforating the paper strip, whose grammage is, for economical reasons, increasingly fine.

The compressed air consumption of the compensation device, according to the invention, is low relative to the pulsed-air device of the prior art. In addition, whereby the air flow is continuous according to this invention, the sound level during operation is very low.

The compensation device adapts to all the flexible printing substrates whether they are printed over their entire surface or not.

Finally, for uses of a paper strip of more significant width, it is possible to increase the number of pairs of deflectors that are used, distributed transversally upstream or downstream from a printing unit.

By way of nonlimiting example, the width of the active zone of a deflector is approximately between 140 and 220 $mm^2$.

For printing machines for which the available space is small, it is possible to arrange deflectors "in staggered rows," i.e., on both sides of the passing printing substrate rather than on just one side of the paper strip as shown in FIG. 7.

The example above was described for printing machines that use an offset printing process, but it can also be applied to the printing machines that use processes for heliogravure or flexography printing. In this case, the pair(s) of deflectors 2 is/are positioned upstream from each of the printing units so as to reduce the width of the printing substrate before its entry into said printing unit so as to anticipate the constriction of the paper strip that takes place at the drying stations placed downstream from each printing unit.

The invention claimed is:

1. A device for compensation for variation of width of a flexible printing substrate (1), in sheet or strip form, that passes, in a multi-color printing machine, between generally rotating printing means that are organized in form of successive printing units ($G_1$, $G_2$, $G_3$, $G_4$), by means of a directed air flow toward the printing substrate (1) for the purpose of modifying the printing substrate's surface evenness, the device comprising:

at least one pair of deflectors (2, 2*a*, 2*a*, 2*c*) that are arranged symmetrically on both sides of an axis (X) along which the printing substrate (1) passes, each deflector comprising an air-blowing chamber (6) that empties onto a deflector surface that is rotated toward the printing substrate (1) and that is oriented in a direction toward a rear of the deflectors in a direction (D) in which said substrate passes, so as to produce an air flow in form of an air knife for the purpose of facilitating, in parallel, the separation of said substrate from the surface of the deflectors and the accompaniment of the entrainment in movement of said printing substrate (1), wherein the deflectors (2, 2*a*, 2*a*, 2*c*) are formed, in the direction (D) in which the printing substrate (1) passes, by a front part (4) and a rear part (5) that are mounted on a base (3), whereby a rear face of the front part (4) and a front face of the rear part (5) form walls of the blowing chamber (6), and wherein the blowing chamber (6) also comprises longitudinal walls formed by blocks (15) positioned between the front part (4) and the rear part (5) of the blowing chamber (6), the blocks (15) for adjusting spacing of the transverse walls relative to one another.

2. A printing machine, comprising:

at least one device for compensation for the variation of width of a flexible printing substrate (1), in sheet or strip form, that passes, in a multi-color printing machine, between generally rotating printing means that are organized in form of successive printing units ($G_1$, $G_2$, $G_3$, $G_4$), by means of a directed air flow toward the printing substrate (1) for the purpose of modifying the printing substrate's surface evenness, the device comprising at least one pair of deflectors (2, 2*a*, 2*a*, 2*c*) that are arranged symmetrically on both sides of an axis (X) along which the printing substrate (1) passes, whereby each deflector comprises an air-blowing chamber (6) that empties onto a surface of deflectors that is rotated toward the printing substrate (1) and that is oriented in a direction toward the rear of the deflectors in the direction (D) in which said substrate passes, so as to produce an air flow in form of an air knife for the purpose of facilitating, in parallel, the separation of said substrate from the surface of the deflectors and the accompaniment of the entrainment in movement of said printing substrate (1), wherein the printing machine is one of i) an offset printing-type printing machine with the device placed downstream from at least one printing unit ($G_1$, $G_2$, $G_3$, $G_4$) and between two printing units (G1, G2, G3, G4) so as to deform locally the printing substrate (1) for the purpose of compensating for the broadening of the width of said substrate that takes place during printing, and ii) heliogravure printing-type or flexography printing-type machine with the device placed upstream from at least one printing unit ($G_1$, $G_2$, $G_3$, $G_4$) and between two printing units so as to deform locally the printing substrate for the purpose of anticipating and compensating for the constriction of the width of said substrate that takes place, in particular during drying, downstream from the printing unit ($G_1$, $G_2$, $G_3$, $G_4$), the device (2) movable vertically towards the printable substrate (1) to impart the deformation of the substrate, said at least one device positioned only on a lower side of the substrate.

3. A device for compensation for variation of width of a flexible printing substrate (1), in sheet or strip form, that passes, in a multi-color printing machine, between generally rotating printing means that are organized in form of successive printing units ($G_1$, $G_2$, $G_3$, Gd, by means of a directed air flow toward the printing substrate (1) for the purpose of modifying the printing substrate's surface evenness, the device comprising:

at least one pair of deflectors (2, 2*a*, 2*a*, 2*c*) that are arranged symmetrically on both sides of an axis (X) along which the printing substrate (1) passes, each deflector comprising an air-blowing chamber (6) that empties onto a deflector surface that is rotated toward the printing substrate (1) and that is oriented in a direction toward a rear of the deflectors in a direction (D) in which said substrate passes, so as to produce an air flow in form of an air knife for the purpose of facilitating, in parallel, the separation of said substrate from the surface of the deflectors and the accompaniment of the entrainment in movement of said printing substrate (1), wherein the blowing chamber (6) is formed, crosswise to the axis (X) along which the printing substrate (1) passes, by two approximately parallel walls that are oriented in a direction toward the rear of the deflector (2) in the direction (D) in which said substrate passes, wherein the two walls are flat and oblique.

4. A printing machine, comprising:

plural multi-color printing units ($G_1$, $G_2$, $G_3$, $G_4$) successively arranged one printing unit after another printing unit along an axis (X), the printing units adapted for passing a flexible printing strip substrate (1) successively between the printing units ($G_1$, $G_2$, $G_3$, $G_4$) along the axis (X); and a device for compensation for variation of width of the flexible printing sheet substrate (1) passing between the printing units ($G_1$, $G_2$, $G_3$, Gd, the device providing a directed air flow toward the printing substrate (1) to modify the substrate's surface evenness, the device comprising a pair of deflectors (2) arranged symmetrically on both sides of the axis (X) that the printing substrate (1) passes, The deflectors (2) movable vertically toward the printing substrate (1), each deflector (2) comprising i) a base (3), ii) a front part (4) mounted on the base (3), iii) a rear part (5) mounted on the base (3), iv) an air blowing chamber (6) separating the front part and the rear part (5), and v) recesses (7, 8) respectively provided in the rear part (5) and in the base (3), the recesses configured for accepting a compressed air source and to supply compressed air to the blowing chamber (6), wherein the compressed air empties from the air blowing chamber (6) onto an upper surface of the deflector (2) rotated toward the printing substrate (1) producing an air flow in a form of an air knife inclined toward the printing substrate (1) and oriented in the direction toward a rear of the deflector (2), the air flow facilitating separation of said substrate from the surface of the deflector and accompaniment of entrainment in movement of said printing substrate.

5. The machine of claim 4, wherein, a front face of the rear part (5) has a convex shape, a rear face of the front part (4) has a concave shape adapted to the convex shape of a front face of the rear part (5), the front face of the rear part (5) and the rear face of the front part define transverse walls of the air blowing chamber (6), and the front face of the rear part (5) and the rear face of the front part are parallel and are oriented in a direction toward a rear of the deflector (2) in a direction (D) that the printing substrate (1) passes.

6. The machine of claim 4, wherein, a front face of the rear part (5) is flat and oblique, a rear face of the front part (4) is flat and oblique, the front face of the rear part (5) and the rear face of the front part define transverse walls of the air blowing chamber (6), and the front face of the rear part (5) and the rear face of the front part are parallel and are oriented in a direction toward a rear of the deflector (2) in a direction (D) that the printing substrate (1) passes.

7. The machine of claim 4, wherein, the upper surface of the deflector has an upward slope terminated by a plate, the upward slope formed by a upper surface (9) of the front part (4) and by a leading edge (10) of the rear part (5) of the deflector (2), the rear part (5) of the deflector is higher than the front part (4) and ends by a flat upper surface (11) approximately parallel to a plane in which the printing substrate (1) passes, the rear part (5) of the deflector (2) further comprising rounded longitudinal sides (12) accommodating a fraction of the air knife and preventing contact with the printing substrate (1), a rear face (13) of the deflector is beveled such that the flat upper surface (11) projects beyond a rearmost surface (14) of the base (3), the rear face (13) providing a downstream air flow (20) to accompany the air knife to prevent the printing substrate (1) from becoming plated against the rear of the deflector (2).

8. The machine of claim 4, wherein, the upper surface of the deflector has an upward slope terminated by a plate, the upward slope formed by a upper surface (9) of the front part (4) and by a leading edge (10) of the rear part (5) of the deflector (2), the rear part (5) of the deflector is higher than the front part (4) and ends by a flat upper surface (11) approximately parallel to a plane in which the printing substrate (1) passes, the rear part (5) of the deflector (2) further comprising rounded longitudinal sides (12) accommodating a fraction of the air knife and preventing contact with the printing substrate (1), a rear face (13) of the deflector has a rounded shape such that the flat upper surface (11) projects beyond a rearmost surface (14) of the base (3), the rear face (13) providing a downstream air flow (20) to accompany the air knife to prevent the printing substrate (1) from becoming plated against the rear of the deflector (2).

9. The machine of claim 4, wherein, a front face of the rear part (5) has a first shape, a rear face of the front part (4) has a shape adapted to the first shape of a front face of the rear part (5), the front face of the rear part (5) and the rear face of the front part define transverse walls of the air blowing chamber (6), the front face of the rear part (5) and the rear face of the front part are parallel and are oriented in a direction toward a rear of the deflector (2) in a direction (D) that the printing substrate (1) passes, and blocks (15) positioned between the front part (4) and the rear part (5), the blocks (5) forming longitudinal walls of the blowing chamber (6).

* * * * *